US010315333B1

(12) United States Patent
Smith

(10) Patent No.: US 10,315,333 B1
(45) Date of Patent: Jun. 11, 2019

(54) METHOD OF REJUVENATING THE INTERIOR OF A TOASTED BARREL

(71) Applicant: Jeremy Smith, Missoula, MT (US)

(72) Inventor: Jeremy Smith, Missoula, MT (US)

( * ) Notice: Subject to any disclaimer, the term of this patent is extended or adjusted under 35 U.S.C. 154(b) by 885 days.

(21) Appl. No.: 14/211,405

(22) Filed: Mar. 14, 2014

Related U.S. Application Data

(60) Provisional application No. 61/785,259, filed on Mar. 14, 2013.

(51) Int. Cl.
*B27M 3/00* (2006.01)

(52) U.S. Cl.
CPC ..... *B27M 3/00* (2013.01)

(58) Field of Classification Search
CPC . Y10T 409/303752; Y10T 409/303808; Y10T 29/49718; B23C 3/00; B23C 2220/00; B23P 6/00; B27M 1/06; B27M 3/00; B27M 3/34; B27H 5/00; B27H 5/08
See application file for complete search history.

(56) References Cited

U.S. PATENT DOCUMENTS

| | | | |
|---|---|---|---|
| 4,558,639 | A | 12/1985 | Hojnoski |
| 4,827,994 | A | 5/1989 | Whitford |
| 5,102,675 | A | 4/1992 | Howell et al. |
| 5,481,960 | A | 1/1996 | Sullivan |
| 5,630,265 | A | 5/1997 | Stone |
| 5,647,268 | A | 6/1997 | Sullivan |
| 6,898,834 | B1 | 5/2005 | Warren |
| 7,357,069 | B1 | 4/2008 | Karasch et al. |
| 7,594,468 | B2 | 9/2009 | Kania et al. |
| 7,771,146 | B2 | 8/2010 | Waterman |
| 7,823,261 | B2 | 11/2010 | Rogers |
| 7,866,254 | B1 | 1/2011 | Karasch et al. |
| 7,878,741 | B2 | 2/2011 | Waterman |
| 7,909,551 | B2 | 3/2011 | Waterman |
| 2009/0126830 | A1 | 5/2009 | Waterman |

OTHER PUBLICATIONS

Jane Firstenfeld, Shift Neutral Barrels Back Into Gear, Feb. 2006, https://www.winesandvines.com/features/article/51236/Shift-Neutral-Barrels-Back-Into-Gear.*

Rebecca Gibb, Cosmetic Surgery for Barrels, Aug. 8, 2012, https://www.wine-searcher.com/m/2012/08/phoenix-wine-barrel-makeover-cosmetic-surgery.*

Charl Theron, Tim Rypstra and Jan Swart, Cleaning and reusing barrels, Aug. 1, 2006, http://www.wineland.co.za/cleaning-and-reusing-barrels/.*

Bruichladdict, Are bourbon barrels re-charred for scotch maturation?, Feb. 3, 2008, http://forum.whiskymag.com/viewtopic.php?t=8302.*

Barrel Builders, Barrel Maintenance and Repair Manual, 1995, p. 14.*

* cited by examiner

*Primary Examiner* — Matthew Katcoff
(74) *Attorney, Agent, or Firm* — Fogarty LLP

(57) ABSTRACT

The interior or core of a toasted wine barrel is milled along the longitudinal grain to varied depths to increase the surface area of the core available to the wine and to present a gradient of the toast surface. The core is milled with a V-shaped corrugated pattern to create a reusable (potentially value-added) barrel. A box-shaped pattern milled into the core doubles the toast surface to expedite oak-wine interaction.

13 Claims, 4 Drawing Sheets

METHOD OF REJUVENATING THE INTERIOR OF A TOASTED BARREL

CROSS-REFERENCE TO RELATED APPLICATIONS

This application claims the benefits of U.S. Provisional Application No. 61/785,259 filed Mar. 14, 2013, the disclosure of which is hereby incorporated by reference in its entirety including all figures, tables, and drawings.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

Wine is aged in toasted oak wine barrels. Hemicellulose of the wood is broken down into simple wood sugars during the toasting process. It is these wood sugars that convey body to the wine. Toast temperatures of 300° F. produce caramelized sugars that develop sweet-associated aromas. Higher toast temperatures of 420° F. impart toasty characteristics to the wine. Sugar and aroma concentrations are highest at the toast surface and decrease with the depth of the toast along a toast gradient.

Oak wood also is composed of several classes of complex chemical compounds that contribute to the flavor or textural note of the wine. Volatile phenols containing vanillin convey vanilla flavors to the wine. Sweet and toasty aromas in the wine come from carbohydrate degradation products containing furfural. Terpenes provide "tea" and "tobacco" notes, while "oak" lactones impart a wood aroma. Hydrolysable tannins contribute to the astringency or "mouth feel" of the wine.

Controlled oxidation takes place in the wine barrel during the aging process. Oxygen slowly migrates through the stave wall in this aging process, as the barrel effectively "respirates." The gradual oxidation decreases wine astringency and increases color and stability of the wine. Barrels of wine are topped off and racked which also introduces a small amount of oxygen to the wine.

The many effects of the barrel on the wine are strongest when the barrel is first toasted and new. Toast characteristics continually diminish the longer the wine is in the barrel until the barrel reaches what is referred to in the wine industry as being in a "neutral" state. This usually occurs after a period between 4-5 years of aging wine. The reason for this degradation of desirable impact is two-fold. First, the basic laws of diffusion kinetics limit the depth to which the liquid medium can leech the toast conversion compounds. This maximum leeching depth ranges from 3-5 mm below the medial surface of the barrel. Second, there is an inevitable build-up of yeasts, tartrates and fining agents, all residual agents in the wine itself, that eventually clog and seal the pores of the wood surface. Reduced porosity continually diminishes the contact surface area of wood to wine making chemical exchange between wood and wine slower and less effective.

To extend the life of a "neutral" wine barrel, two things are done. The barrel core can be resurfaced to reveal fresh wood (see, for example, U.S. Pat. Nos. 4,827,994; 5,630,265; 7,771,146, 7,823,261; 7,878,741; and 7,909,551 and U.S. Patent Application Publication 2009/0126830). During this process, the entire toasted and wine soaked area of the barrel is removed so the barrel can be re-toasted. With this type of resurfacing however there is a risk that not all the wine in the natural cracks and fissures of the barrel will be removed. Re-toasting of the trapped wine can cause undesirable off-flavors in wine aged in the re-toasted barrel. Alternatively, "neutral" barrels continue to be used but are supplemented with oak adjuncts. These adjuncts (see, for example, OAK INFUSION SPIRAL™ at www.infusion-spiral.com and U.S. Pat. Nos. 4,558,639; 5,102,675; 5,647,268; 5,481,960; 6,898,834; 7,357,069; 7,594,468; and 7,866,254) are pieces of oak, usually in a mesh bag, that are put into the wine barrel to expose aging wine to fresh or newly toasted oak. Oak adjuncts may provide the surface area but have never been considered to produce the same effects as a new, toasted wine barrel.

Wine barrels are expensive. Replacement of barrels impacts the per case expense of wine. Re-toasting and oak adjuncts are not an ideal solution to reusing toasted barrels. A need therefore remains for a method to recapture and reuse the original toasted area of a wine barrel so the barrels do not have to be replaced.

All patents, patent applications, provisional patent applications and publications referred to or cited herein, are incorporated by reference in their entirety to the extent they are not inconsistent with the teachings of the specification.

BRIEF SUMMARY OF THE INVENTION

The invention is a method for resurfacing and rejuvenating the core of a toasted barrel. The method involves milling the interior of a barrel along its longitudinal grain to create an increased surface area and expose a gradient of toast surface to contact the barrel contents. In a preferred embodiment the core is milled with a V-shaped corrugated pattern. In another preferred embodiment a box-shaped corrugated pattern is milled into the barrel interior. Alternatively, the core is uniformly milled to remove the neutral wood portion of the toast.

DETAILED DESCRIPTION OF INVENTION

Figure 1:
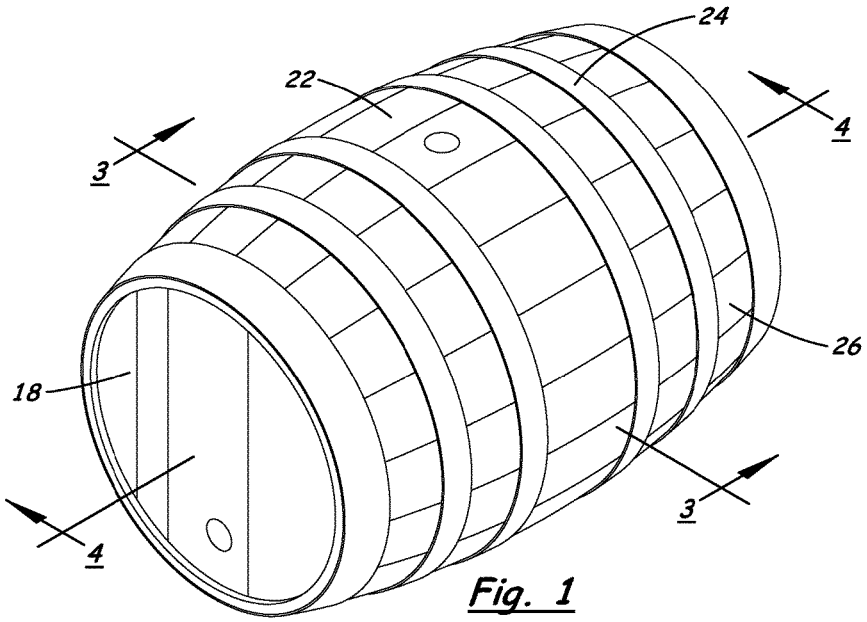
FIG. 1 is a front perspective view of a toasted wine barrel.

The invention involves a method for resurfacing the core of a toasted barrel. The subject method as discussed herein is for resurfacing a wine barrel. The applicant notes however that the methods disclosed can be used to resurface the interior of any wooden toasted barrel, including, but not limited to, barrels used to age whiskey and other spirits.

Used wine barrels are often cored so they can be reused. The coring process removes build-up of wine associated materials from the prior use including tartrates, fining agents, etc., it exposes a new wood layer, and it allows better migration of oxygen from the exterior of barrel to the interior of the barrel. Current coring methods remove a deep (up to 8 mm) even layer of wood from the barrel interior in an effort to remove all of the heat-affected, or toasted wood. This is in preparation to re-toast the barrel. As noted, however, re-toasting these barrels runs a distinct and historically documented risk of toasting wine that is still trapped in the natural cracks and fissures of the wood. This toasting of trapped wine creates undesirable off-flavors in the barrel and wine.

The method of the subject invention leaves as much of this original heat-affected wood as possible so it can be reused. The barrel is not re-toasted. Therefore, there is no risk of toasting trapped wine in barrels treated with the subject method. The method of the subject invention cuts longitudinally with the grain to mill an adjustable depth of wood from the interior of the wine barrel and create a variety of patterns on the barrel core. The subject method therefore not only conveys the advantages to the barrel of a regular coring process but also increases the total surface area of toasted wood available for contact with liquid and it exposes a new toast surface that can ranges in depth inside of the toasted wood gradient.

When drained of wine, the interior of a toasted barrel is covered with a layer of tartrates, yeasts, and fining agents 10. Beneath it, but still within the depth of the toast gradient 12, lies a layer of neutral wood material 14. Neutral wood is the most medial portion of the interior of a used wine barrel wherein the majority (over 95%) of wine soluble toast conversion compounds have been leeched by the wine contents over time. Beneath the neutral wood layer and within the toast gradient 12 there can be a layer of toast conversions trapped in the wood lattice. This sugar layer 16 is part of the original toast not reached by the wine. The method of the subject invention maximizes access to this sugar band 16.

A wine barrel has a head 18 and a bottom 20. A plurality of staves 22 captured within at least two hoops 24 form the body of the barrel. The barrel has an outside or lateral surface 26 and an interior or medial surface 28. It is the interior or medial surface which contacts the wine and that is toasted prior to use.

The method of the subject invention removes a portion of the toast of a used wine barrel to reveal a new surface area of the toasted core. The new surface area of the toasted core is then available to be accessed when the barrel is used to age a new batch of wine.

Figure 6:
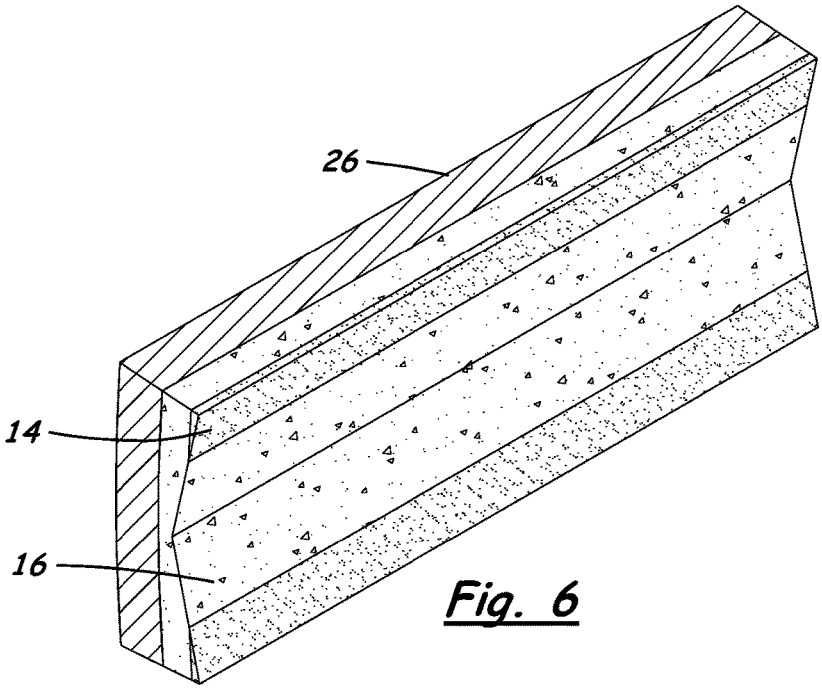
FIG. 6 is a perspective, partial cross-sectional view of the interior of a used toasted wine barrel resurfaced by a preferred embodiment of the method of the subject invention which creates a V-shaped pattern longitudinally inside the wine barrel.

In a preferred embodiment of the method of the subject invention, a portion of the toast is removed by milling the interior of the barrel. The milling cores the barrel but does not remove all the toast 12 nor does it access the untoasted, raw wood 30 (FIG. 6). Preferably, the interior of the barrel is milled to remove the tartrate, yeast, and fining agents layer 10 and the neutral wood layer 14 to reveal the sugar band 16.

Toast depth is determined manually by taking horizontal core samples of the barrel. Typically, toast depth within a wine barrel is 4-7 mm. A skilled craftsman can also estimate toast depth from toast color and manufacturer. Finally, toast depth can be determined chemically and can be defined as wood material that has exceeded 270° F. during the toasting process. The toasting process creates a toast gradient of wood material beginning at the medial wall of the barrel and extending outward towards the lateral wall of the barrel. The lateral edge of the toast depth gradient comprises wood material that has reached temperatures of 270° F. and is chemically identified by the presence of 5HMF (hydroxymethyl-2-furfural).

In another preferred embodiment of the method of the subject invention, a portion of the toast is removed by milling the barrel longitudinally, thus material is removed from the toast along the grain of the stave 22 from head 18 to bottom 20 or from bottom to head of the barrel. Milling lines often are, but need not be, continuous from head to bottom.

Figure 2:
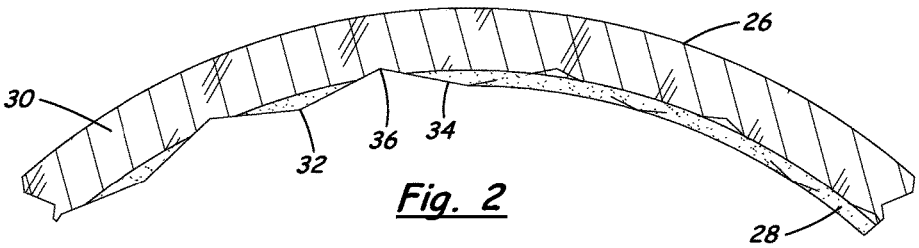
FIG. 2 is a top, partial cross-sectional view along 3-3 of FIG. 1 of a toasted wine barrel resurfaced by a preferred embodiment of the method of the subject invention which creates a V-shaped pattern longitudinally inside the wine barrel.
Figure 3:
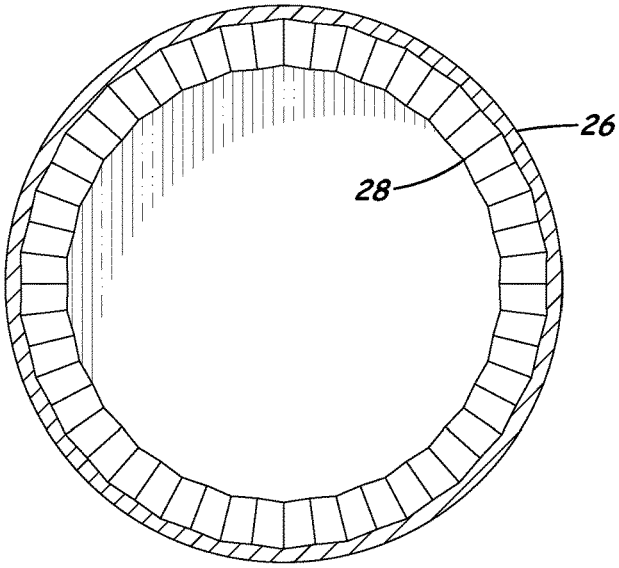
FIG. 3 is a cross-sectional view along 3-3 of FIG. 1 of a toasted wine barrel resurfaced by a preferred embodiment of the method of the subject invention which creates a V-shaped pattern longitudinally inside the wine barrel.
Figure 4:
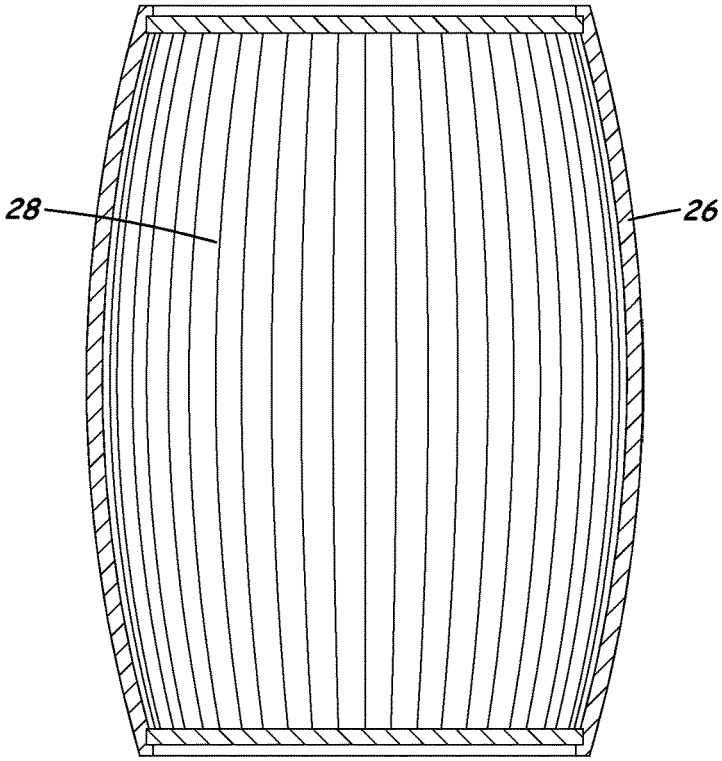
FIG. 4 is a cross-sectional view along 4-4 of FIG. 1 of a toasted wine barrel resurfaced by a preferred embodiment of the method of the subject invention which creates a V-shaped pattern longitudinally inside the wine barrel.
Figure 5:
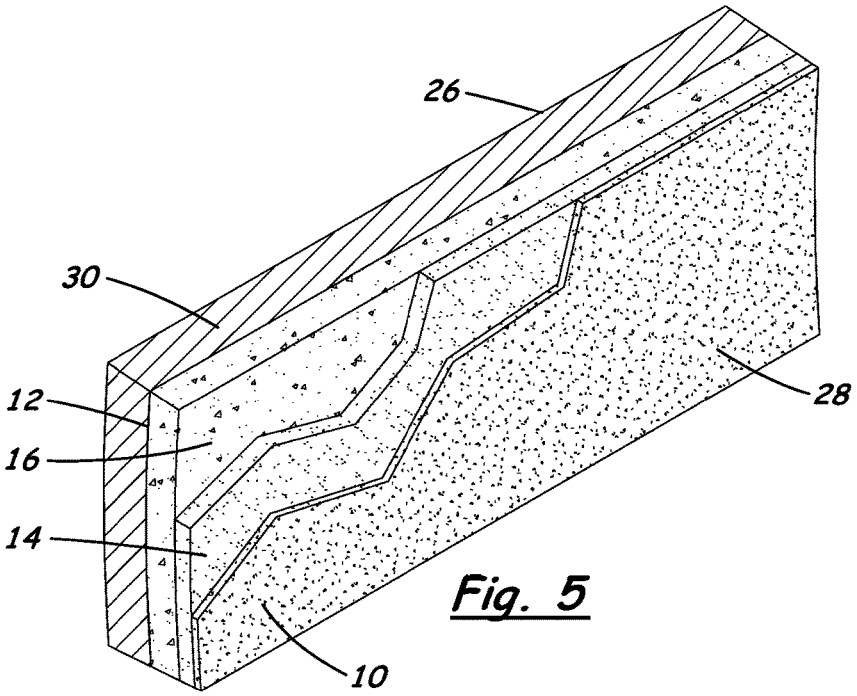
FIG. 5 is a perspective, partial cross-sectional view of the interior of a toasted barrel showing the layers present after use of the barrel to age wine.

In a particularly preferred embodiment, the core is milled longitudinally into a V-shaped corrugated pattern. The V-core pattern exposes a gentle range of the barrel's toast gradient 12 for contact with a new batch of wine. In the exemplified embodiment, the angle of the V is about 15°. The pattern is easy to clean and the barrel can be reused. In the exemplified pattern created by this method shown in FIG. 2, the tartrate, yeast, fining agent layer 10 is removed and a portion of the neutral wood material 14 remains at the tips 32 of the arms of the V 34. Preferably, the V-core pattern does not penetrate through the toast gradient to expose raw wood. In some instances however milling through the gradient may be desired to perhaps expose the unique sugars and wood tannins at the depth of or below the toast gradient. The milling angle would be increased and the apex 36 of the V reveals raw wood. It is preferred however that should the subject process reveal raw wood that it be no more than 50 percent of the total cut surface, and most preferably less than 25 percent. Raw wood (untoasted) possesses a new set of compounds which can quickly add too much astringency to the wine if too large a surface area is in contact with the wine. The cut surface is that surface that is exposed by the milling process.

Figure 7:
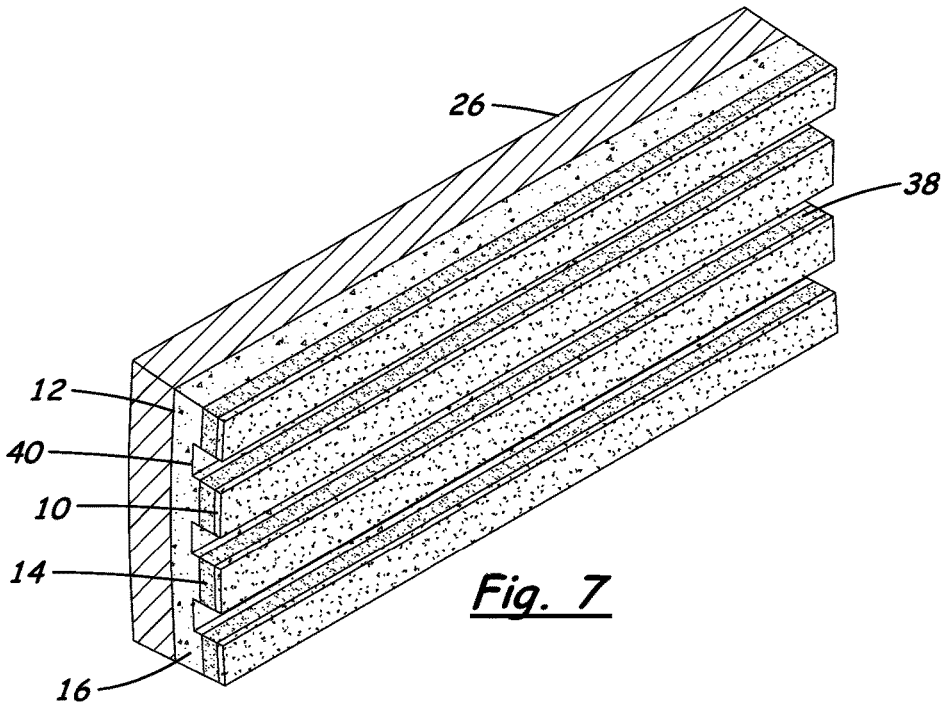
FIG. 7 is a perspective, partial cross-sectional view of the interior of a used toasted wine barrel resurfaced by another preferred embodiment of the method of the subject invention which creates a box-shaped pattern longitudinally inside the wine barrel.
Figure 8:
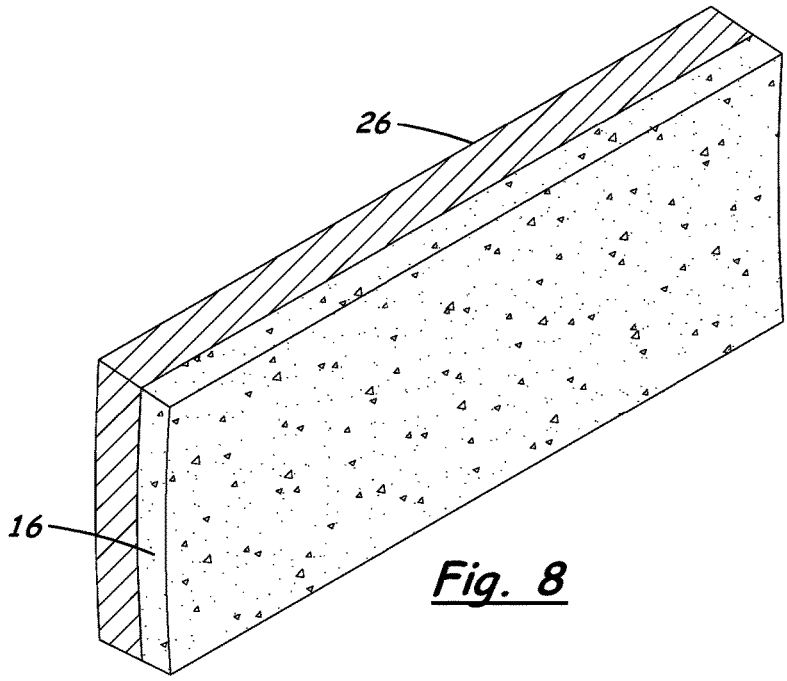
FIG. 8 is a perspective, partial cross-sectional view of the interior of a used toasted wine barrel resurfaced by another preferred embodiment of the method of the subject invention which removes the tartrates, yeast, and fining agents layer and the neutral wood material layer to reveal the sugar layer band inside the wine barrel.

Another particularly preferred embodiment of the method of the subject invention a box-shaped corrugated pattern is cut longitudinally into the barrel interior (FIG. 7). This pattern creates the opportunity for the wine to extract all remaining toast characteristics of the barrel and doubles the barrel's toast surface area. In the exemplified embodiment, the box-core pattern retains a portion of the tartrate, yeast, fining agents layer 10. Neutral wood material 14 is revealed along the walls 38 of the box. The bottom of the box cut 40 accessed the sugar band 16. One skilled in the art would recognize that the depth and exposed surfaces of this pattern can vary to access different portions of the toast gradient of parts of the barrel.

Applicant notes that although only two patterns are exemplified, it would be apparent to one skilled in the art that other patterns could be milled within the toast gradient that achieve the results of the method of the subject invention. These patterns are created by milling the barrels longitudinally along the grain to increase the surface area of the core of the barrel. Created patterns further present a gradient of the toast surface area in toasted barrels. The subject method effectively cleans barrel interiors and helps winemakers regain the oak impact characteristics from their existing barrel inventory which can reduce the per case oak expense by up to 35%.

The method of the subject invention can be carried out manually or with a machine. A machine or apparatus offers consistency in the process. A preferred apparatus to effectuate the process of the subject invention has a moveable cutter arm that travels along a raceway to mill the interior of a barrel supported by a barrel frame. The barrel frame has a lift and drive cone to position, hold, and rotate the barrel during the milling process. The subject apparatus can be fully automated or can be controlled manually to take advantage of the experience of the skilled artisan. An apparatus currently used to carry out the subject method is mobile to allow the unit to be transported to the location of the barrels. This offers a savings of time and money to wineries that lose valuable time when barrels are sent away to be cored and re-toasted. Applicant notes however that the unit can be stationary and multiple units could be installed in a factory setting.

It is understood that there are other embodiments of the invention other than that described herein, which is provided to explain the invention to those skilled in the state of the art and should not be construed as limiting the claims made below.

The invention claimed is:

1. A method of rejuvenating a barrel, comprising:

providing a wooden barrel having an interior surface defining a space for storing wine, the interior surface previously exposed to a toasting process resulting in a toasted core outwardly from the interior surface, wherein, after being exposed to the wine, the toasted core comprises a fining agents layer on the interior surface, a neutral wood layer under the fining agents layer, and a sugar layer under the neutral wood layer; and milling the interior surface to remove a portion of the fining agents layer and a portion of the neutral wood layer to expose a remaining portion of the neutral wood layer and a portion of the sugar layer, wherein the barrel further comprises untoasted wood under the sugar layer, and wherein milling the interior surface does not expose the untoasted wood.

2. The method of claim 1, wherein milling the interior surface comprises removing all of the fining agents layer.

3. The method of claim 1, wherein milling the interior surface comprises milling a V-shaped pattern in which the fining layer is removed, a portion of the neutral wood layer remains at the tips of the V-shaped pattern, and the sugar layer is revealed at the apex of the V-shaped pattern.

4. The method of claim 1, wherein milling the interior surface comprises milling a box-shaped pattern in which a portion of the fining layer is removed, a portion of the neutral wood layer is exposed on walls of the box-shaped pattern, and the sugar layer is revealed at the bottom of the box-shaped pattern.

5. The method of claim 1, wherein the toasted core comprises wood material that has exceeded 270° F. during the toasting process.

6. The method of claim 1, wherein the toasted core comprises wood material that includes 5HMF (hydroxymethyl-2-furfural).

7. The method of claim 1, further comprising:

filling the wooden barrel with the wine after milling the interior surface without exposing the interior surface to an additional toasting process.

8. A method of rejuvenating a barrel, comprising:

providing a wooden barrel having an interior surface defining a space for storing wine, the interior surface previously exposed to a toasting process resulting in a toasted core outwardly from the interior surface, wherein, after being exposed to the wine, the toasted core comprises a fining agents layer on the interior surface, a neutral wood layer under the fining agents layer, and a sugar layer under the neutral wood layer; and milling a section of the interior surface to remove all of the fining agents layer and a portion of the neutral wood layer within the section and to expose a remaining portion of the neutral wood layer and a portion of the sugar layer, wherein the barrel further comprises untoasted wood under the sugar layer, and wherein milling the interior surface does not expose the untoasted wood.

9. The method of claim 8, wherein milling a section of the interior surface comprises milling a V-shaped pattern in which the fining layer is removed, a portion of the neutral wood layer remains at the tips of the V-shaped pattern, and the sugar layer is revealed at the apex of the V-shaped pattern.

10. The method of claim 8, wherein milling a section of the interior surface comprises milling a box-shaped pattern in which a portion of the fining layer is removed, a portion of the neutral wood layer is exposed on walls of the box-shaped pattern, and the sugar layer is revealed at the bottom of the box-shaped pattern.

11. The method of claim 8, wherein the toasted core comprises wood material that has exceeded 270° F. during the toasting process.

12. The method of claim 8, wherein the toasted core comprises wood material that includes 5HMF (hydroxymethyl-2-furfural).

13. The method of claim 7, further comprising:

filling the wooden barrel with the wine after milling the interior surface without exposing the interior surface to an additional toasting process.

* * * * *